United States Patent [19]

Brugger et al.

[11] 4,311,073

[45] Jan. 19, 1982

[54] METHOD AND APPARATUS FOR CUTTING BRICK MOULDINGS FROM A CLAY STRIP

[75] Inventors: Karl Brugger, Dieteheim; Josef Schwarz, Vonringen, both of Fed. Rep. of Germany

[73] Assignee: Lingl Corporation, Paris, Tenn.

[21] Appl. No.: 68,732

[22] Filed: Aug. 20, 1979

[30] Foreign Application Priority Data

Sep. 6, 1978 [DE] Fed. Rep. of Germany ..... 2838739

[51] Int. Cl.[3] ..... B26D 7/06

[52] U.S. Cl. ..... 83/23; 83/155; 83/210; 83/251; 83/651.1; 83/620; 264/157

[58] Field of Search ..... 264/57, 67, 157, 145, 264/146, 148; 83/23, 251, 418, 651.1, 926 B, 155, 210, 620

[56] References Cited

U.S. PATENT DOCUMENTS

| | | | |
|---|---|---|---|
| 3,461,196 | 8/1969 | Bowles | 264/157 |
| 3,468,998 | 9/1969 | Lingl | 264/157 |
| 3,478,896 | 11/1969 | Pearne | 264/67 |
| 3,602,963 | 9/1971 | Lingl | 264/157 |
| 3,715,417 | 2/1973 | Pope | 264/157 |
| 3,838,621 | 10/1974 | Keck | 83/651.1 |
| 3,882,218 | 5/1975 | Bixel | 264/157 |
| 4,085,635 | 4/1978 | Lingl | 83/651.1 |

FOREIGN PATENT DOCUMENTS

| | | |
|---|---|---|
| 1801479 | 10/1970 | Fed. Rep. of Germany . |
| 2438236 | 3/1977 | Fed. Rep. of Germany . |
| 7818485 | 5/1978 | Fed. Rep. of Germany . |
| 2712057 | 9/1978 | Fed. Rep. of Germany . |
| 1228031 | 8/1960 | France . |

*Primary Examiner*—James B. Lowe

*Attorney, Agent, or Firm*—Cushman, Darby & Cushman

[57] ABSTRACT

An improved method and apparatus for efficiently and at an improved rate cutting an extruded clay column, strand or strip, or a portion thereof, into individual brick mouldings. A conveyor brings the uncut strip portion into a predetermined position beneath a cutting device and by causing relative vertical movement between the conveyor and a lifting table the uncut portion is transferred to the lifting table, itself comprised of a plurality of separate supports spaced apart both transversely of and in the direction of travel defined by the conveyor. While supported by the lifting table, the clay strip is cut by a plurality of cutting wires secured under tension in a frame which is lowered with respect to the table so that the wires pass through the clay. Thereafter the frame is raised to its starting position and the cut mouldings redeposited on the conveyor by again causing relative vertical movement between the conveyor and table. Then the conveyor moves the cut mouldings away from beneath the cutting device and substantially simultaneously moves a fresh uncut clay strip into cutting position so that these steps can be repeated to cut another batch of mouldings.

18 Claims, 2 Drawing Figures

METHOD AND APPARATUS FOR CUTTING BRICK MOULDINGS FROM A CLAY STRIP

This invention relates to a method of, and an apparatus suitable for use in, cutting brick mouldings from an extruded clay strip.

BACKGROUND OF THE INVENTION

Individual brick mouldings are usually produced by cutting an extruded clay strip or strand and this can occur with a variety of cutting approaches. For example, the clay strip can be continuously cut into brick mouldings immediately after emerging from the extrusion press. Alternately, the strip can be initially cut into portions and the portions then advanced into a specific position where they are cut into brick mouldings or reset into a further position for cutting into brick mouldings. Cutting can be performed with or without waste at the end of the strip or portion.

A number of different cutting apparatus have been proposed. One such apparatus comprises a plurality of spaced apart wires clamped in a cutting frame. The cutting frame reciprocates vertically and cuts the clay strip into brick mouldings as the strip emerges from a die. During cutting, the cutting frame moves, in the direction of, and in synchronism with, strip movement and the cutting frame is returned to its upper starting position during intervals between cuts. Cutting is performed during the upward and the downward movement of the cutting frame.

A disadvantage of such an apparatus, however, is that only thin-walled hollow strands can be cut which must be soft extruded, otherwise the clay strip tends to deform during upward cutting. It is also disadvantageous to cut in both the upward and downward direction because the wire cannot be guided back into the cut since the advancing motion of the clay strip causes the cut ends of the brick mouldings to be pushed against each other. Further, the cutter is complex because a substantial amount of controlling means are required to synchronize strip movement, cutting and cutting frame movement and thus too is disadvantageous.

In another known apparatus, brick mouldings are cut from a clay strip emerging from an extrusion press using wires clamped in a cutting frame, the clay strip being supported during cutting by plates. The plates and the cutting wires are movable relative to each other on return of the cutting frame to the starting position so that the wires move between the brick mouldings. In this apparatus, cutting occurs only during the downward movement of the cutting frame.

Disadvantages of this apparatus are substantially the same as those relating to the previously-described apparatus. Furthermore, because of the mass which has to be moved, output from the apparatus is limited and an even greater amount of control is required.

In another device, a portion cut from the clay strip is transferred to a separate conveyor and moved into a specific position where it is cut into brick mouldings. The conveyor includes blades spaced apart a predetermined distance and as a cutting frame, which holds cutting wires, is moved vertically the wires pass through and cut the clay strand and likewise through the spaces between the blades. After cutting, the wires are returned to a starting position whereupon the brick mouldings are advanced and a new clay strand portion is moved into cutting position.

A disadvantage of this apparatus is that the blades can have only a limited height so that when cutting through particularly hard clay strands, or strands having a large cross-section, substantial bending of the cutting wires occurs so that the middle portion of the bottom strip edge is not cut through. While the wire could be supported in the middle, so as to halve the bending length, this would produce marks on the cut surfaces of the brick mouldings.

A transfer plate is required to effect the transfer of the mouldings from the blade conveyor to an adjoining conveyor, owing to the diameter of the driving pulley required for the blade conveyor, and this prevents the reliable transfer of thin brick mouldings. Also, the brick mouldings are pushed over the transfer plate due to friction with the blade conveyor.

It is also known to push clay strands laterally through a wire hub. This apparatus can, however, be used only for cutting solid or cored bricks with thick walls.

In another cutting device, clay strand portions are transversely conveyed on a belt table including spaced apart narrow belts. During cutting, the wires of a cutting wire hub pass through the strand and the spaces between the belts. However, a separate belt table is required for each cutting length so that the apparatus becomes complex and expensive.

In yet a further cutting device, clay strand portions are held on a lifting table and are perpendicularly raised through a wire hub with the cut brick mouldings then being laterally pushed off the lifting table.

The disadvantage of this apparatus is the limited output because no fresh strip portions can pass to the cutting position while the cut brick mouldings are being pushed off. A further disadvantage is the additional mechanical complexity called for by the required transfer from one conveying device to another.

SUMMARY OF THE PRESENT INVENTION

The preferred embodiments of the present invention provides both a method and apparatus by which clay strands or strips or portions thereof can be cut into brick moulding lengths at a high output rate and without any separate expenditure for controls. Further, the cut brick mouldings are conveyed by the same conveyor on which the uncut strand or portions thereof were conveyed into the cutting position. A first aspect of this invention is a method of cutting brick mouldings from clay strands or strips. The method begins by conveying a strip or a portion thereof into a specific position by a conveyor having spaced apart conveyor belts followed by transferring the strip from its specific position on the conveyor to a table, which includes supports for supporting the strip, by the relative lifting or lowering movements between the table and the conveyor. The table supports pass through the spaces between the conveyor belts during the relative movement, then with the clay strip supported by the supports it is cut into brick mouldings by moving a cutting frame having cutting wires tensioned in one plane, downwardly so that the cutting wires pass through the spaces between the supports. After cutting, the cutting frame is returned to its raised starting position and the strip is again transferred to the conveyor by the relative lowering or lifting movement between the conveyor and the table so that the brick mouldings again bear on the conveyor. Using the conveyor, the brick mouldings are moved from the cutting position and a further strand or strip to be cut next is moved by that conveyor into the cutting position.

Advantageously there is provided a method of cutting brick mouldings from a clay strand or strip which includes the steps of conveying a clay strip or a portion thereof to a specific cutting position by a conveyor which includes spaced apart conveyor belts. When at that position, the strip is lifted from the conveyor by a lifting table which includes spaced apart supports for supporting the strip during lifting, which supports pass through the spaces between the conveyor belts. The strip is cut when in the raised position by moving a cutting frame, having cutting wires tensioned in one plane, downwardly through spaces between the supports in the lifting table. Thereafter the cutting frame is raised back to its starting position and the lifting table is lowered so that the brick mouldings are redeposited on the conveyor. As they are moved along, a further uncut strip is conveyed by the conveyor into the specific position and the process continues in this manner.

The apparatus built according to this invention includes a conveyor having a number of spaced apart conveyor belts for conveying the clay strand or strip into a specific cutting position and for conveying therefrom the brick mouldings which have been cut from the strip. The apparatus also includes a lifting table comprised of supports for supporting the strip, which supports can pass through the spaces between the spaced apart conveyor belts, the conveyor and/or the table being movable to lift and lower the strip such that the strip can be transferred from the conveyor to the table and vice versa. The clay strand or strip is cut by cutting wires tensioned in one plane in a frame with the supports in the table being spaced apart to allow the cutting wires to pass therebetween. Finally, the apparatus includes drive means for lowering the cutting frame to effect cutting and for raising the cutting frame into a starting position after cutting as well as for driving the conveyor and effecting the relative movement between the conveyor and the lifting table.

Another aspect of this invention relates to the brick mouldings cut from a clay strand or strip using the method and/or apparatus described herein and also to bricks produced from such brick mouldings.

The advantages of the preferred embodiments of this invention flow from the simplicity of the method and apparatus. Without any separate control means it is possible to cut a strip, particularly a portion cut from an extruded strip, into brick mouldings and to convey the brick moulds from the cutting position using the same conveyor on which the portions were conveyed into the cutting position so that no transfer problems occur and mouldings of a large and/or small size can be produced equally advantageously.

Preferably, the supports are support plates. Advantageously, the cutting wires are tensioned in the cutting frame in an inclined plane extending transversely of, preferably at right angles to, the conveying direction.

The apparatus preferably also includes a monitoring device for determining when the strip has reached the specific position.

BRIEF DESCRIPTION OF THE DRAWINGS

For a better understanding of the present invention and to show how the same may be put into effect, reference will now be made, by way of example to the accompanying drawings, in which.

DETAILED DESCRIPTION OF THE PREFERRED EMBODIMENT OF THE PRESENT INVENTION

Figure 1:
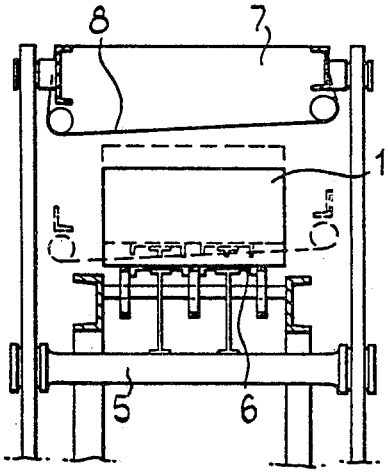
FIG. 1 shows a sectional view of an embodiment of an apparatus in accordance with this invention.
Figure 2:
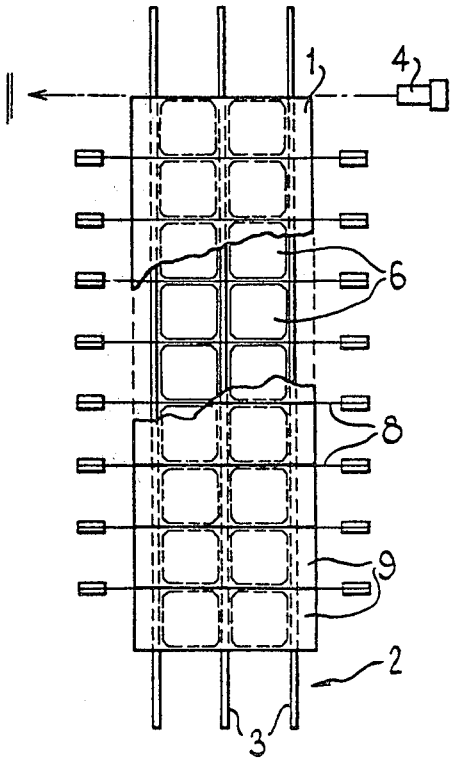
FIG. 2 shows a plan view of the apparatus of FIG. 1.

With reference to both FIGS. 1 and 2, a clay strand or strip 1 is conveyed by a belt conveyor 2 comprised of a plurality of narrow conveyor belts 3 which are spaced apart a predetermined distance. The conveyor belts 3 may be made from any strong material such as nylon. Strip 1 is normally a portion of an extruded strand or strip of clay. Conveyor 2 not only moves strips 1 into a specific position for cutting, it also conveys the cut brick mouldings 9 from that specific position following cutting as will be more fully explained hereinafter. A lifting table 5, having support plates 6 which are spaced apart transversely of the conveying direction, is positioned with respect to the belt conveyor 2 such that when support plates 6 are raised and lowered on operation of lifting table 5 support plates 6 pass between adjacent conveyor belts 3 thereby lifting strip 1 from conveyor belts 3. Reversal of such moving of lifting table 5 redeposits the cut brick mouldings back onto the conveyor belts 3 after cutting. A monitoring or sensing device 4, such as an electric eye, is provided for determining when strip 1 has reached the specific cutting position.

A cutting frame 7 is provided with a plurality of cutting wires 8 tensioned in an inclined plane extending transversely of, and in this embodiments perpendicularly to, the conveying direction. The cutting frame 7 is vertically reciprocable by conventional means with the cutting of strand 1 being performed during downward movement. Support plates 6 are also spaced apart in the conveying direction to allow cutting wires 8 to pass therebetween during cutting.

In use, strip 1 is conveyed by conveyor 2 into the specific predetermined cutting position with the monitoring device 4 determining when this position has been reached. In this position strip 1 is lifted from the belt conveyor 2 by support plates 6 when relative vertical movement between conveyor 2 and table 5 due to the raising of the lifting table 5. Lifting table 5 is also raised and covered by conventional means, such as hydraulic cylinders.

After strip 1 has been raised, cutting frame 7 is moved downwardly so that wires 8 pass through strip 1 to cut the strip into individual brick mouldings 9. The relative positions immediately after cutting of lifting table 5, strip 1 and cutting frame 7 is shown by the discontinuous lines in FIG. 1.

On completion of cutting, cutting frame 7 is returned to a raised starting position and at the same time lifting table 5 is lowered so that cutting wires 8 move back through the spaces they produced in strip 1 during cutting and which now separate mouldings 9.

Mouldings 9 are redeposited on conveyor 2, and are then moved away by conveyor 2 from the region beneath cutting frame 7 simultaneously with the entry of a new strip 1 thereunder.

In the above-described embodiment, movement of lifting table 5 effects transfer of the strip and brick mouldings from and to conveyor 2. However, as is apparent, the present invention also encompasses embodiments wherein movement of conveyor 2 could effect such transfers. In one such embodiment, the conveyor is lowered to transfer the strip to the table and, after cutting, is raised to transfer the brick mouldings thereto. Furthermore, if desired, transfer could be effected by movement of both the table and the conveyor.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent processes and products.

What is claimed:

1. A method of cutting brick mouldings from a clay strip comprising the steps of conveying a strip to be cut into a specific position on a conveyor comprised of spaced apart conveyor belts, transferring the strip from the specific position on the conveyor to a table having a spaced apart support, by causing relative vertical movement between the table and the conveyor so that the supports can pass through the spaces between the conveyor belts, cutting the strip transversely to said conveyor while supported by the supports so as to form individual brick mouldings, redepositing the cut mouldings on the conveyor by again causing relative vertical movement between the conveyor and the table and conveying the cut mouldings away from the cutting position in the same direction as when fed into the cutting position while substantially simultaneously conveying another uncut strip into the specific cutting position.

2. The method as in claim 1, wherein the step of cutting includes the steps of moving a cutting frame, having at least one cutting wire tensioned therein, downwardly so that the cutting wires passes through the strip and passes between the spaced apart supports, and raising the cutting frame after cutting to its starting position.

3. The method as in claim 1, wherein transfer of the strip between the conveyor and the table is accomplished by moving the table upwardly and downwardly.

4. A method according to claim 1, wherein the strip is transferred from the conveyor to the table by lowering the conveyor.

5. A method of cutting brick mouldings from a strip comprising the steps of conveying the strip in a first direction into a specific position on a conveyor comprised of spaced apart conveyor belts, moving the strip from the specific position into a cutting position by effecting relative vertical movement between the strip and the conveyor by means passing between the spaced apart conveyor belts, cutting the strip transversely to said conveyor while in the cutting position so as to form individual brick mouldings and redepositing the brick mouldings on the conveyor and conveying the brick mouldings in said first direction while conveying a further strip also in said first direction into the specific position.

6. The method as in claim 5, wherein the moving of the strip into the cutting position includes the step of raising a lifting table comprised of a plurality of separated supports which, during lifting, pass through the spaced apart conveyor belts and lift the strip therefrom.

7. The method as in claim 6, where the step of cutting includes the steps of moving a cutting frame, having at least one cutting wire tensioned therein, downwardly so that the cutting wire passes through the strip and passes between the separated supports, and raising the cutting frame after cutting to its starting position.

8. A method according to claim 2 or 6, wherein the supports are support plates.

9. A method according to claim 2 or 7, wherein at least one cutting wire is tensioned in the cutting frame in an inclined plane extending transversely of the conveying direction.

10. An apparatus suitable for use in cutting brick mouldings from a strip comprising a conveyor for moving in a first direction having spaced apart conveyor belts for conveying the strip into a specific position and for conveying therefrom brick mouldings cut from the strip, a table comprised of a plurality of supports, for supporting the strip, which can pass through the spaces between the spaced apart conveyor belts, the conveyor and the table being relatively vertically movable so that the strip can be transferred back and forth between the conveyor and the table, a cutting frame having at least one cutting wire extending transversely to said conveyor and being tensioned in one plane, the supports being spaced apart in said first direction to allow said at least one cutting wire to pass therebetween, first drive means for driving the conveyor, second drive means to cause the relative vertical movement between said conveyor and said table and third drive means for moving the cutting frame to effect cutting and for returning the cutting frame to its starting position after cutting.

11. Apparatus as in claim 10, wherein said table is vertically movable to effect the transfer of the strip from said conveyor to said table prior to cutting and the redepositing of the cut mouldings on the conveyor following cutting.

12. Apparatus according to claim 10, wherein the conveyor is vertically movable to lift and lower the strip and brick mouldings.

13. An apparatus suitable for use in cutting brick mouldings from a strip including a conveyor having a plurality of spaced apart conveyor belts for conveying the strip in a first direction and into a specific position and for conveying the cut brick mouldings away from that position, lifting table means for placing the strip in a cutting position, the said lifting table means including a plurality of separated supports for supporting the strip, means for causing relative vertical movement between said conveyor and said lifting table so that during such movement said separated supports pass through the spaces between the spaced apart conveyor belts to thereby place the strip on said lifting table means for cutting and redepositing cut mouldings on said conveyor following cutting, cutting means extending transversely to said conveyor for cutting the strip when in the cutting position on said lifting table and means for moving said cutting means to effect cutting and for returning said cutting means to a starting position after cutting.

14. Apparatus as in claim 13, wherein said cutting means includes a cutting frame having at least one cutting wire tensioned therein so that when said cutting means is moved to effect cutting said at least one cutting wire passes through said strip and within the space defined between at least two of said separated supports.

15. Apparatus as in claim 14 wherein said cutting frame includes a plurality of cutting wires tensioned in one plane.

16. Apparatus as in claim 15, wherein the plane is inclined transversely to the direction in which said conveyor moves.

17. An apparatus according to claim 10 or 13, wherein said supports are support plates.

18. An apparatus according to claim 10 or 13 further including a monitoring device for determining when the strip has reached the specific position.

* * * * *